US007520009B1

(12) United States Patent
Heck

(10) Patent No.: US 7,520,009 B1
(45) Date of Patent: Apr. 21, 2009

(54) PATIENT TRANSPORTATION DEVICE WITH RETRACTABLE, EXTENDIBLE HANDLES TO FACILITATE LIFTING OF A PATIENT

(76) Inventor: Robert Walter Heck, 4990 Heuga Ct., Park City, UT (US) 84098

( * ) Notice: Subject to any disclaimer, the term of this patent is extended or adjusted under 35 U.S.C. 154(b) by 198 days.

(21) Appl. No.: 11/633,685

(22) Filed: Dec. 4, 2006

Related U.S. Application Data

(60) Provisional application No. 60/742,843, filed on Dec. 5, 2005.

(51) Int. Cl.
*A61G 1/00* (2006.01)
*A61G 1/048* (2006.01)

(52) U.S. Cl. ..... 5/625; 5/626; 128/870

(58) Field of Classification Search ..... 5/625–628, 5/703; 128/870; 296/20; 294/140, 170, 294/171

See application file for complete search history.

(56) References Cited

U.S. PATENT DOCUMENTS 606,355 A * 6/1898 Moore ..... 5/115
3,111,687 A * 11/1963 Sacks ..... 5/627
3,663,972 A * 5/1972 Denton ..... 5/625
6,845,533 B1 * 1/2005 Tulette ..... 5/626

OTHER PUBLICATIONS http://thomasems.com, Thomas E.M.S. A Thomas Transport Packs Company, Thomas Handles, 2 pages, 2006.

http://thomasems.com, Thomas E.M.S. A Thomas Transport Packs Company, Transfer Flat 2 pages, 2006.

* cited by examiner

*Primary Examiner*—Michael Trettel
(74) *Attorney, Agent, or Firm*—Thorpe North & Western LLP

(57) ABSTRACT

A patient transportation device includes a rigid backboard with means for securing a patient thereon. At least one handle is extendibly coupled to the backboard, and at least one connector is coupled between the backboard and the at least one handle to suspend the backboard from the handle when the handle is extended from the backboard. The at least one connector and the at least one handle are retractable with respect to the backboard.

20 Claims, 7 Drawing Sheets

PATIENT TRANSPORTATION DEVICE WITH RETRACTABLE, EXTENDIBLE HANDLES TO FACILITATE LIFTING OF A PATIENT

PRIORITY CLAIM

Benefit is claimed of U.S. Provisional Patent Application 60/742,843 filed on Dec. 5, 2005, which is herein incorporated in its entirety for all purposes.

BACKGROUND OF THE INVENTION

1. Field of the Invention

The present invention relates generally to patient transportation, and more particularly to backboard lifting devices.

2. Related Art

Emergency medical personnel, such as paramedics with ambulance services or fire departments, commonly transport victims or patients from an accident scene to a hospital. Backboards are commonly used to immobilize the spine of the patient during transport. Such backboards are typically flat, stiff boards that are sized to carry patients in a prone or supine position. Usually, these backboards have handles or handholds located around the periphery of the board. Thus, in use, a patient lies on the board and medical personnel lift the board with the patient to place them on a stretcher or gurney.

Because backboards are generally flat and only a few inches tall, lifting the board usually requires medical personnel to bend over, or squat down, near the board in order to grasp the handles of the board. Lifting a substantial load, such as a patient, from a bent or squatting position puts tremendous strain and loading on the back of the lifting personnel. Additionally, backboards often only need to be lifted to the height of a lowered gurney, or approximately eighteen inches, so that the gurney can be slid under the backboard to carry the patient.

Lifting a backboard to this height does not allow the medical personnel lifting the backboard to completely straighten up, but instead requires the lifter to remain in a bent or semi-bent position while sustaining the load of the patient until a gurney is placed under the backboard. Sustaining such a load in a bent position increases the strain on the lifters back and can result in injury to the lifter. Furthermore, medical personnel lifting in such a manner can become unstable or lose their balance and cause further injury to the patient.

SUMMARY OF THE INVENTION

It has been recognized that it would be advantageous to develop a method and device that reduces the bending required by the lifter in order to lift a patient on a backboard. In addition, it has been recognized that it would be advantageous to develop a method and device to reduce back injuries or strain from lifting a patient on a backboard. In addition, it has been recognized that it would be advantageous to develop a method and device to lift a patient on a backboard onto a gurney.

The present invention provides for a patient transportation device including a rigid backboard with means for securing a patient thereon. At least one retractable handle can be extendibly and retractably coupled to the backboard, and at least one connector can be coupled between the backboard and the at least one handle to suspend the backboard from the handle when the handle is extended from the backboard.

The present invention also provides for a patient transportation device including a rigid backboard with means for securing a patient on the backboard. At least one stowable handle is extendibly coupled to the backboard, and extendible between a stowed position fixed with respect to the backboard and an extended position removed from the backboard. At least one connector is coupled between the backboard and the at least one handle to suspend the backboard from the handle when the handle is in the extended position.

The present invention also provides for a method for transporting patients including positioning the patient on a rigid backboard. Removable handles can be displaced upward from the backboard to extend connectors coupled between the handles and the backboard. The backboard, with the patient disposed thereon, can be lifted by the extended handles.

Additional features and advantages of the invention will be apparent from the detailed description which follows, taken in conjunction with the accompanying drawings, which together illustrate, by way of example, features of the invention.

DETAILED DESCRIPTION

Figure 1:
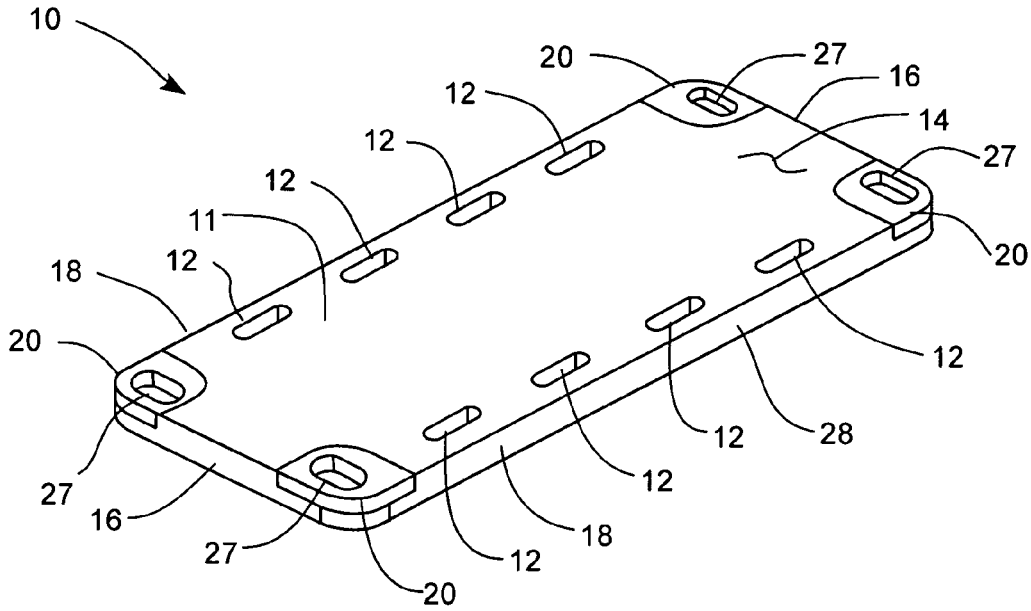
FIG. 1 is a perspective view of a patient transportation device in accordance with an embodiment of the present invention, shown with removable handles in a retracted or stowed position.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides for a patient transportation device for transporting patients and especially those with spinal, head or neck injuries. The patient transportation device includes a backboard that has handles that can be removed or extended from the backboard to provide a mechanical advantage when lifting the backboard with the patient thereon. The handles are connected to the backboard by extendible connectors, such as cords or hinged rods. The length of the connectors can position the handles to an elevation above the backboard that allows medical personnel to more easily lift the backboard from off the ground, thus resisting back injury or back strain. The handles and connectors can be manually or automatically retractable or stowable to the backboard so that the connectors and handles will not interfere with the operation or transportation of the backboard when not being used to lift the backboard.

As illustrated in FIGS. 1-9, a patient transportation device, indicated generally at 10, in accordance with the present invention is shown for use in transporting injured patients. The patient transportation device 10 can include a rigid backboard 11 sized and shaped to accommodate a patient, as is commonly used in securing patients with head, neck or spinal injuries. The backboard can be any type of backboard for transporting patients, including split boards or scoops. The backboard 11 can have a plurality of handholds 12 disposed around a perimeter thereof. The backboard 11 can have an uppermost surface 14 that can support a patient in a prone or supine position. The backboard 11 can have a general rectangular shape including two shorter ends 16, and two longer lateral sides 18. It is understood that the longer lateral sides can taper, as is known in the art. The handholds 12 can be spaced around the backboard 11 along the ends 16 and sides 18. The handholds 12 can be apertures or holes extending through the backboard 11 sized to receive the fingers and/or palm of a user. The backboard 11 can be formed of a material that will not interfere with x-rays, such as fiberglass, composites, wood, and the like, so that x-ray equipment or the like can be used while the patient is secured to the backboard.

The backboard 11 can have straps 70 (FIG. 3) with buckles 72 for securing or strapping the patient to the backboard. The straps 70 with buckles 72 are one means for securing a patient to the backboard 11. The straps can also be means for immobilizing a patient on the backboard. Other means, as known in the art, can also be used to secure patients to the backboard of the patient transportation device 10.

The patient transportation device 10 can also include a plurality of removable, extendable and/or stowable handles 20 removably and extendably coupled to the backboard 11 and stowable in a fixed relationship to the backboard. The handles 20 can be spaced around the backboard 11 along the ends 16 and sides 18, or at the corners. The handles can have a hole 27 for facilitating grasping of the handle. Thus, as illustrated in FIGS. 1-5, a pair of handles 20 can be located on one end of the patient transportation device 10, and another pair of handles 20 can be located on the opposite end of the patient transportation device 10.

The backboard 11 can also includes a plurality of handle receptacles 24 sized and shaped to receive the plurality of handles 20. The handle receptacles 24 can be recesses in the upper surface 14 of the backboard 11 that are positioned around a peripheral edge 28 of the backboard. The recesses 24 can be sized and shaped to house or stow each of the plurality of handles 20 and position the handles approximately flush or below the plane of the upper surface 14. Thus, the handles can be flush or within a normal perimeter or envelope of the backboard so that they do not interfere with operation of the backboard.

The receptacles or recesses 24 can have an undercut 80 with the top surface 14 of the backboard 11 extending over or overlapping the undercut, and thus the handle. The removable handles 20 can have a similar shape as the undercut 80 so that a portion 82 of the handle fits into the undercut and the upper surface 14 of the backboard 11 overlaps at least a portion 82 of the handle 20. Advantageously, the undercut helps to guide the handle 20 back into the handle receptacle 24 when the handle is retracted. It will be appreciated that other designs or shapes can be used to guide the handles.

At least one connector 40 is extendibly coupled between the backboard 11 and the handles 20. The connector can be any means for connecting the handles to the backboard. For example, the connector can be flexible cords, flexible tubing, flexible straps, rods, a linkage of rods, and the like.

Figure 7:
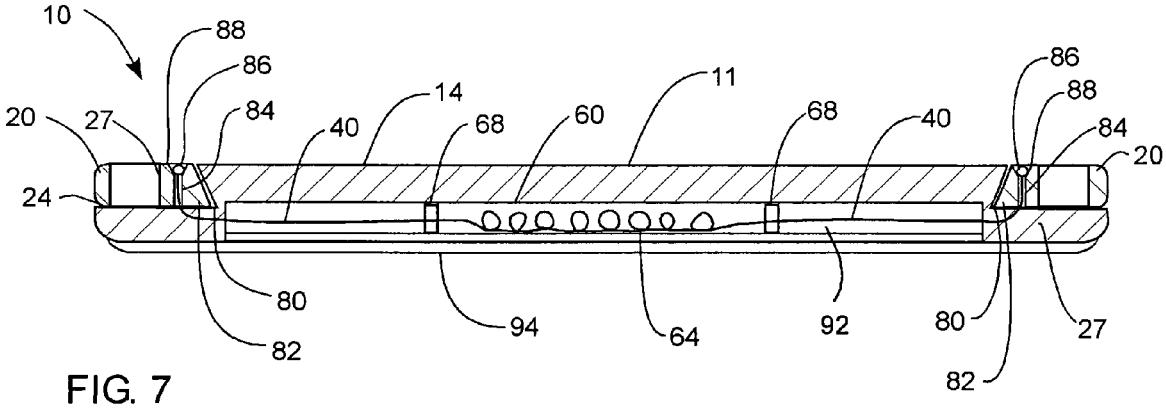
FIG. 7 is a cross section side view of the patient transportation device of FIG. 1 shown with removable handles in a retracted or stowed position.

One end 44 of the connector can be coupled to the backboard device 10 and the other end 48 of the connector can be coupled to the handles 20. The connectors 40 allow the handles 20 to be removed or extended from the backboard, while still coupling the handles to the backboard. Thus, the handles 20 can be elevated with respect to the backboard prior to lifting so that emergency personnel are in a better position for lifting. In one aspect, a plurality of connectors 40 can be spaced around the backboard 11 and can correspond in position to the spacing of the handles 20. In this case, each one of the plurality of connectors 40 can be associated with one of the plurality of handles 20. For example, as shown in FIG. 7, each handle 20 can have a small aperture 84 through which the connector 40 can extend. The aperture 84 can have a wider end 88 and the end of the connector 48 can have means for stopping and retaining 86 the connector end 48 in the wider end 88 of the aperture 84. In the case the connector is a flexible cord, the means for stopping can be a knot tied in the flexible cord, or an enlargement coupled to a flexible cord. In the case where the connector is a rod or linkage of rods, the rod can be coupled to the handle by a fastener, such as a bolt, screw, and the like.

Figure 2:
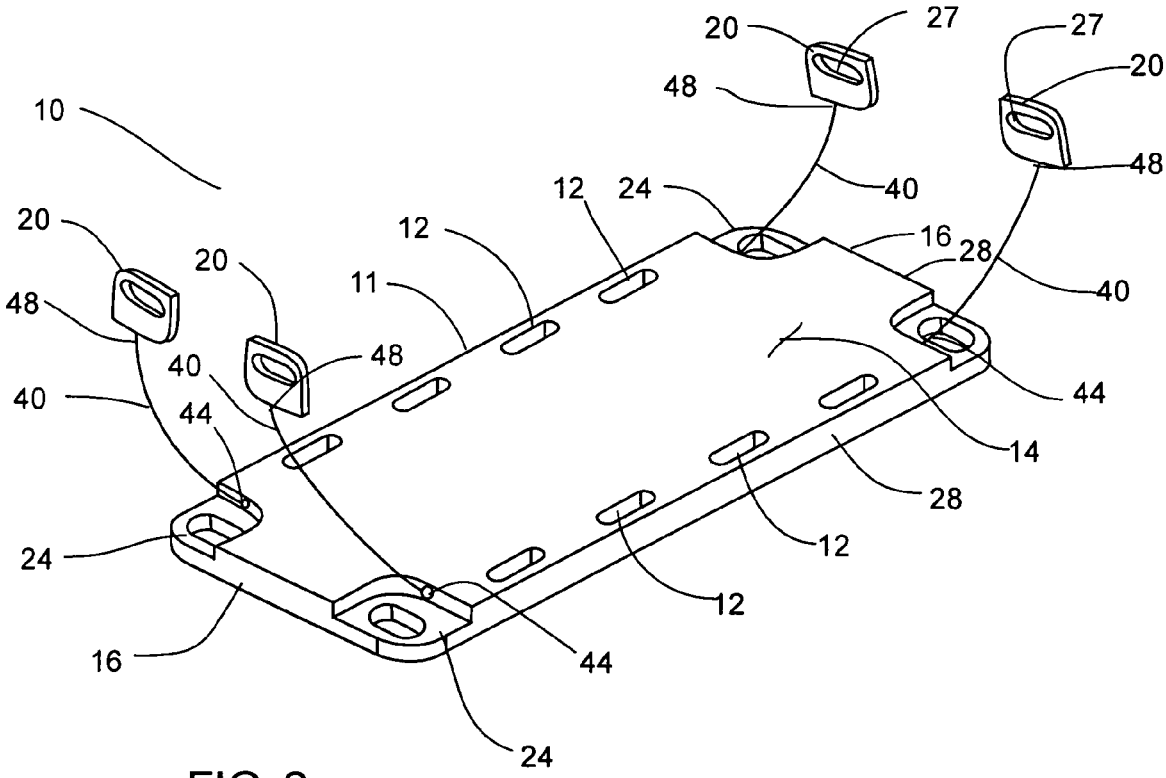
FIG. 2 is a perspective view of the patient transportation device of FIG. 1, shown with the removable handles in an extended or elevated position.
Figure 3:
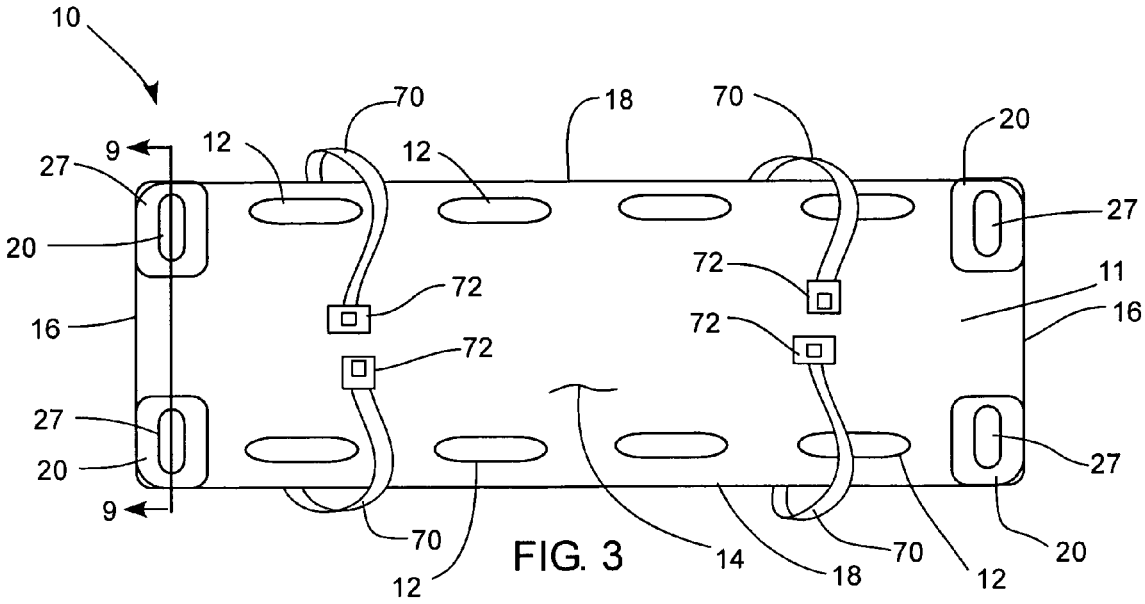
FIG. 3 is top view of the patient transportation device of FIG. 1.
Figure 4:
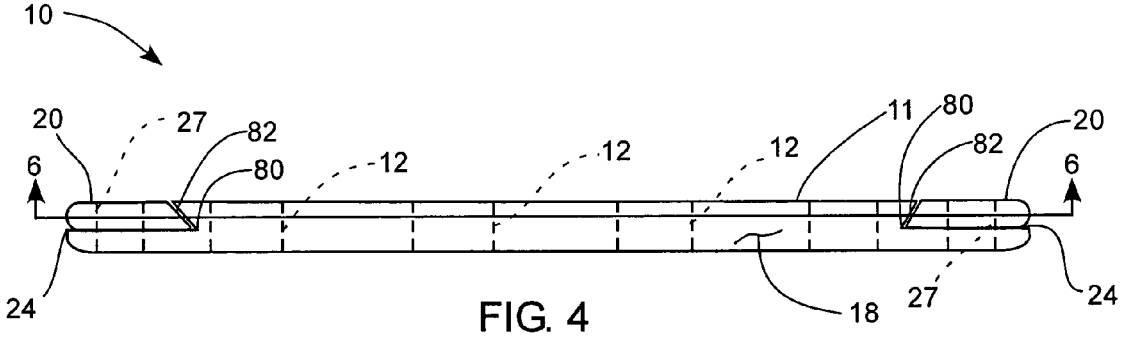
FIG. 4 is a side view of the patient transportation device of FIG. 1.
Figure 5:
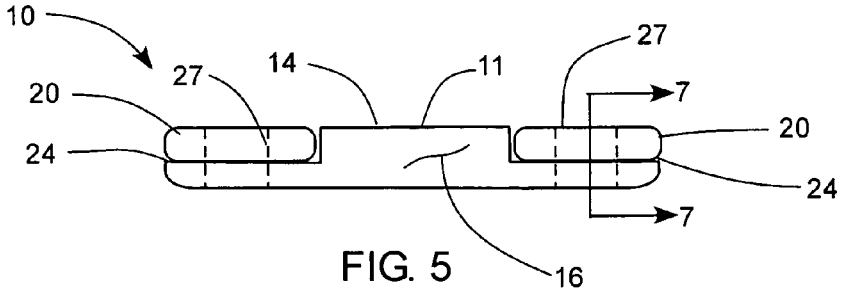
FIG. 5 is a front view of the patient transportation device of FIG. 1.

The handles 20 and/or connectors 40 can be extendible between an extended or elevated position, as shown in FIG. 2, and a retracted or stowed position, as shown in FIG. 1. In the extended position, the connectors 40 are extended out of the backboard 11 to a predetermined length and the handles are elevated to a predetermined elevation. The predetermined length can position the handles 20 at a more comfortable and ergonomic position for lifting the patient transportation device 10. In one aspect, the predetermined length can be approximately 18 inches. Thus, the connectors 40 can suspend the backboard 11 below the handles 20 when the handles are removed and pulled away from the backboard to extend the connectors 40 to the extended position. A stopper 68 can be formed at the end 44 of the connector 40, similar to that at the other end 48 near the handles, to engage the backboard so that the backboard is suspended from the connector 40. The stopper can be larger than a hole in the backboard through which the connector passes.

The connectors 40 and/or the handles 20 are also retractable to or stowable with respect to the backboard 11. In the retracted or stowed position, the handles 20 are fixed with respect to the backboard. For example, the handles 20 can be adjacent or abutting the backboard, or can be nested within the handle receptacles 24. In addition, the connectors 40 can be stowed within the backboard. The handles 20 can be located adjacent to or in the backboard 11. The connectors 40 and handles 20 can be manually or automatically retractable.

The connectors 40 can include flexible cords, such as cable or nylon rope or straps. The flexible cords can suspend the backboard 11 from the handles 20 and allow the backboard to swing from the handles 20. Advantageously, allowing the backboard 11 to swing from the handles 20 can provide a smoother motion to the patient being transported on the patient transportation device 10 during lifting and turning of the backboard 11. The connectors 40 can be or can include elastic in order to retract the handles as described below.

The handles 20 and connectors 40 can be formed of a material that will not interfere with x-rays so that x-ray equipment or the like can be used while the patient is strapped to the backboard.

Figure 6:
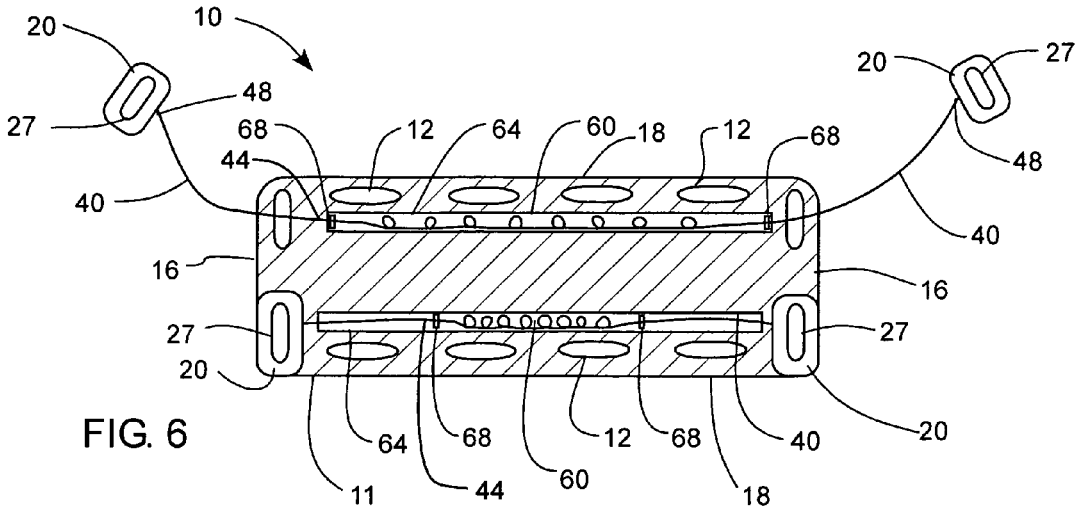
FIG. 6 is a cross section top view of the patient transportation device of FIG. 1.
Figure 8:
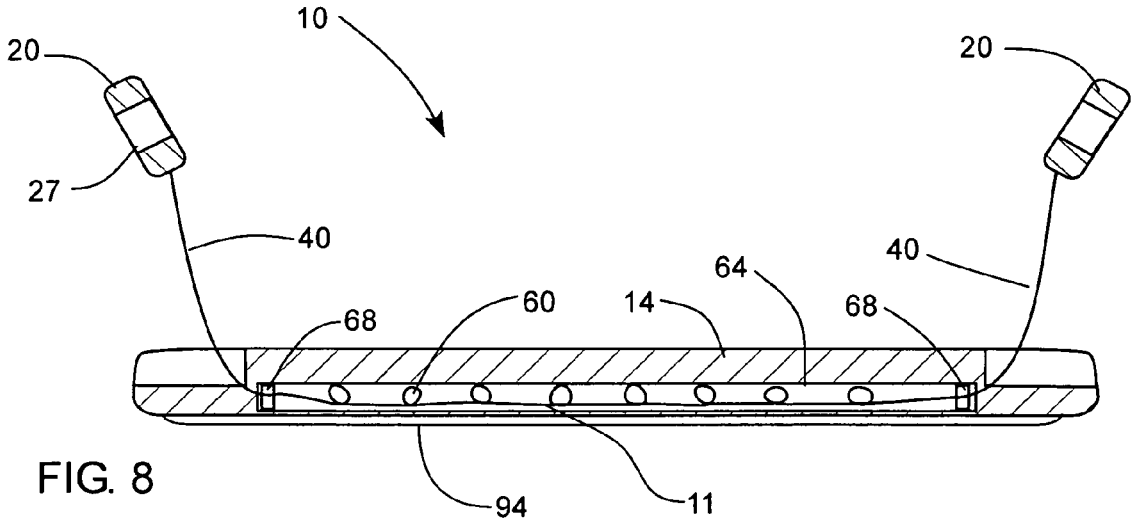
FIG. 8 is a cross section side view of the patient transportation device of FIG. 1, shown with the removable handles in an extended or elevated position.

As shown in FIGS. 6-8, the patient transport device 10 can also include means for retracting the connectors 40 to a retracted or stowed position with respect to the backboard 11. For example, a biasing device 60 can bias the plurality of connectors 40 and the handles 20 to the retracted or stowed position. The biasing device 60 can be coupled between a pair of connectors 40, and can bias both connectors to the retracted position. Specifically, one connector 40 can be positioned on one end 16 of the backboard 11 and another connector 40 can be positioned on the opposite end 16 of the backboard 11 and the biasing device 60 can inter-couple the two connectors 40.

In one aspect, the biasing device 60 can be a spring. The connectors 40 can be inelastic cords. Thus, as the connectors 40 are pulled to the extended position by the handles 20, the spring 60 can stretch and allow the connectors 40 to extend away from the backboard 11. Similarly, when the handles 20 are released the spring 60 can return to an un-stretched state, thereby retracting the connectors 40 into the backboard, and retracting the handles to the stowed position. The spring 60 can be housed in a preformed channel 64 within the backboard 11. The stoppers 68 can be positioned on the connectors 40 at predetermined positions to restrict extension of the connectors 40 to a predetermined length.

The spring 60 is one example of a means for retracting the connectors 40 and handles 20 to the retracted position. Other means for retracting can also be used for retracting the handles 20 with respect to the backboard 11. For example, the biasing device can be an elastic cord, a pneumatic cylinder, a hydraulic cylinder, a linear spring, a coiled spring, and combinations of these devices. It will be appreciated that the biasing device 60 can be formed of a material that will not interfere with x-rays, such as elastic cord, so that x-ray equipment or the like can be used while the patient is strapped to the backboard 11. It will also be appreciated that the connectors, such as one or more rods, can be manually retracted into the backboard.

It will be appreciated that movable parts such as the retractable handles and biasing device 60, and load bearing parts such as the connectors 40 will experience wear and tear due to use. Advantageously, such parts can easily be removed and replaced on the patient transportation device 10 of the present invention. Replacing worn parts in this manner provides a low cost alternative to replacing the entire backboard. In one aspect, a handle and means for retracting a connector and the handle can be provided as a unit that can be added to a backboard.

Figure 9:
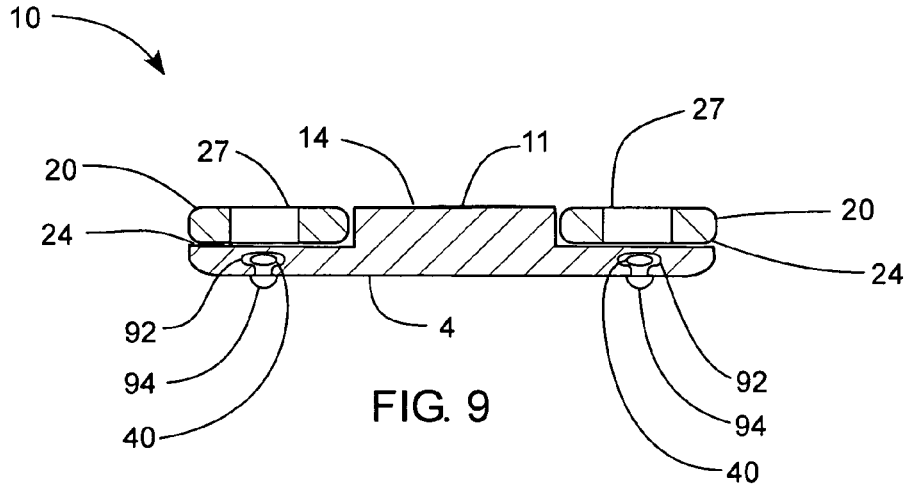
FIG. 9 is a cross section front view of the patient transportation device of FIG. 1, shown with removable handles in a retracted or stowed position.

Referring to FIGS. 7-9, the backboard 11 can have a channel 92 extending longitudinally along the length of the backboard and open, or partially open along the length, on a bottom side 4. The connector 40 and retracting means can extend through the channel 92. A cap 94 can be placed over the channel to cover the channel and retain the connector and retracting means in the backboard 11. Advantageously, the cap 94 can extend along the bottom 4 of the backboard 11 in a longitudinal direction and can act as a track or rail upon which the backboard can slide or rest upon a support surface.

In use, the patient transportation device 10 is placed on the ground or other support surface near an injured person or patient. The patient is then moved and secured to the backboard 11. Medical personnel can then move to a low position close to the backboard 11 such as kneeling down, squatting, or bending over near the backboard. The handles 20 can then be removed from the backboard 11, and the connectors 40 can be pulled out to the extended position. In addition, the handles can be pulled against the means for retracting the at least one handle. Once in the extended position, the medical personnel can arise from the low position to a near standing position. The medical personnel can then straighten their own backs and bend their legs in order to maintain their grasp of the handles 20. From this semi-standing or semi-squatting position, the medical personnel can lift the backboard 11 and patient simply by straightening their legs and rising to a full standing position. In this way, the present invention provides great ergonomic benefit and advantage to medical personnel when lifting a backboard 11 and patient, since the load of the patient can be carried by the medical personnel's legs and not by their backs or outstretched arms.

It will be appreciated that, while the retractable handles of the present invention are shown in FIGS. 1-9 coupled only to a standard backboard, the concept of such handles can be applied to other types of backboards as well. For example, retractable handles could be used on split backboards, snow sled backboards, scoop backboards, and the like.

Figure 10:
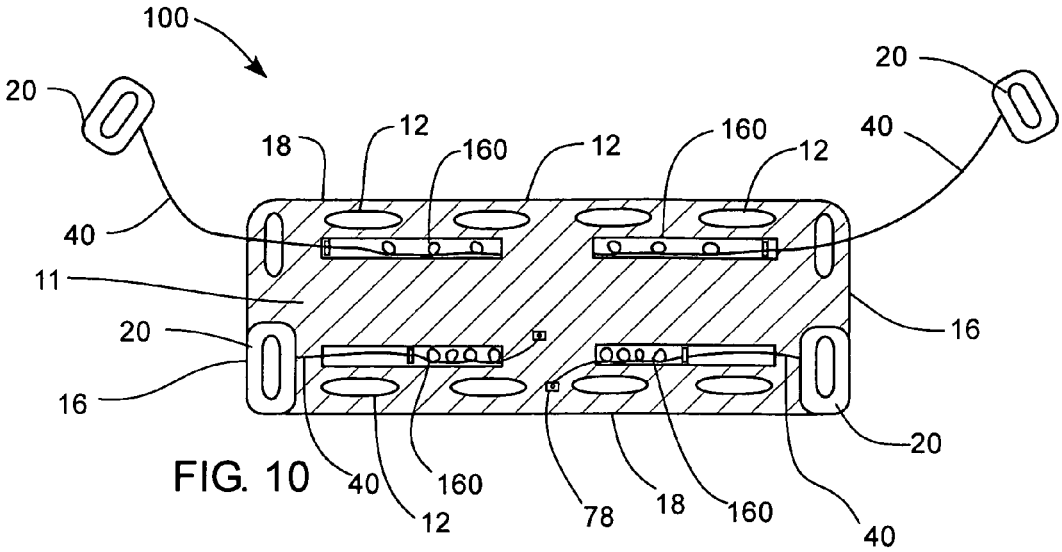
FIG. 10 is cross section top view of a patient transportation device in accordance with another embodiment of the present invention, shown with two handles in a retracted or stowed position and two handles in and extended or elevated position.

Referring to FIG. 10, another patient transportation device, indicated generally at 100, is shown in accordance with another embodiment of the present invention that is similar in many respects to the patient transport device 10 described above and shown in FIGS. 1-8. Additionally, the patient transportation device 100 can have separate biasing devices 160 for each of the removable handles 20. The biasing devices 160 can each be coupled to the backboard 11 independently from one another by suitable fasteners 78, such as bolts, screws or the like.

Figure 11:
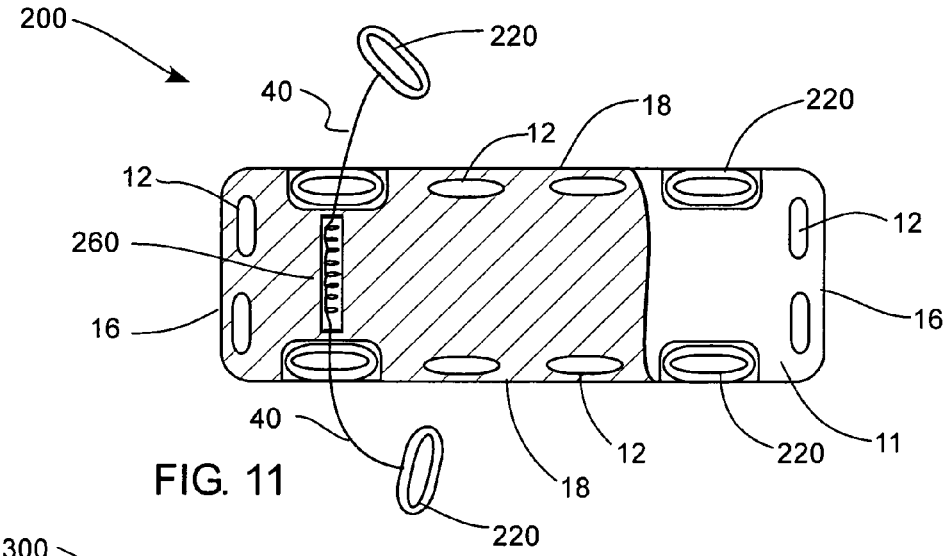
FIG. 11 is cross section top view of a patient transportation device in accordance with another embodiment of the present invention, shown with two handles in a retracted or stowed position and two handles in and extended or elevated position.

Referring to FIG. 11, another patient transportation device, indicated generally at 200, is shown in accordance with another embodiment of the present invention that is similar in many respects to the patient transport device 10 described above and shown in FIGS. 1-8. Additionally, the patient transportation device 200 has removable handles 220 located along the lateral sides 18 of the backboard 11. A biasing device 260 can extend laterally through the backboard 11. It will be appreciated that the removable handles 220 of the present invention could be located along the ends 16 of the patient transportation device 10 as shown in FIGS. 1-8, or on the sides 18 of the patient transportation device 200, as shown in FIG. 9. Similarly, the removable handles 220 could be located on both the ends and the sides.

Figure 12:
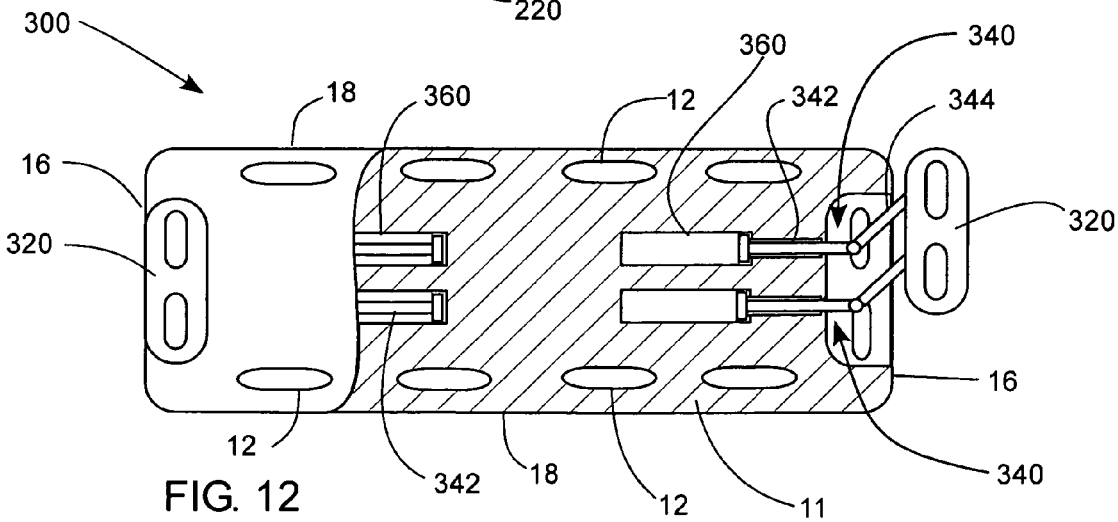
FIG. 12 is cross section top view of a patient transportation device in accordance with another embodiment of the present invention, shown with two handles in a retracted or stowed position and two handles in and extended or elevated position.

Referring to FIG. 12, another patient transportation device, indicated generally at 300, is shown in accordance with another embodiment of the present invention that is similar in many respects to the patient transport device 10 described above and shown in FIGS. 1-8. Additionally, the patient transportation device 300 can have a plurality of connectors, indicated generally at 340, that include a linkage of rigid rods 342 and 344 pivotally coupled together. In use, the rods 342 and 344 can be extended from the backboard device 300 along the plane of the backboard device. When fully extended, the linkage 340 can be pivoted upward to raise the handle 320 above the backboard. The backboard device 300 can also have a hydraulic or pneumatic cylinder spring 360, as known in the art, as a biasing device. Additionally, the patient transportation device 300 can have a double handle 320 positioned on each end 16 of the backboard device.

Figure 13:
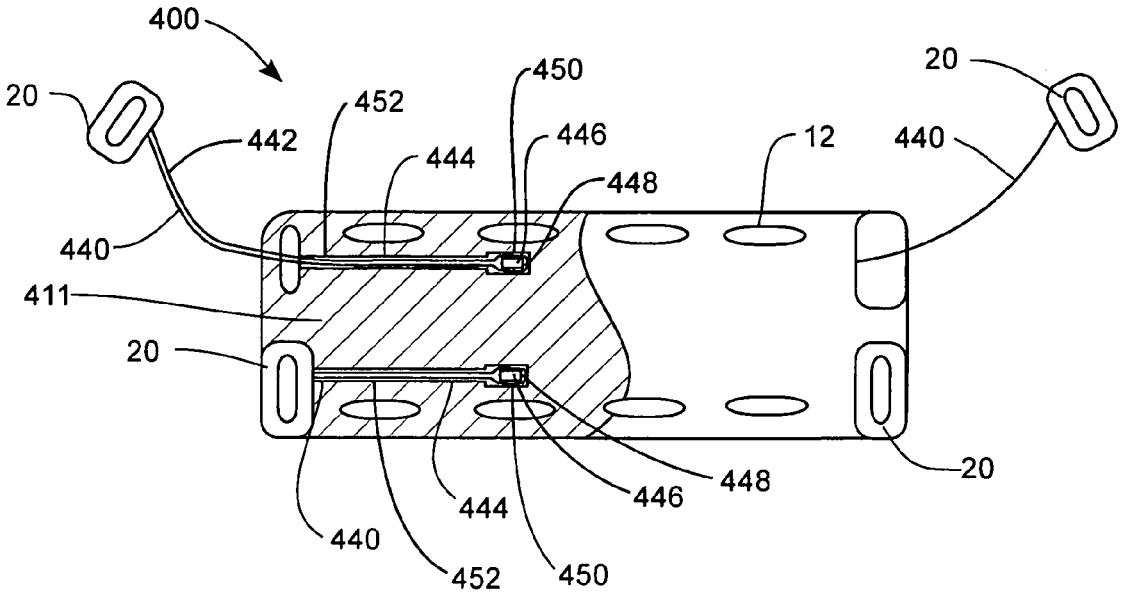
FIG. 13 is a top view of a patient transportation device in accordance with another embodiment of the present invention.

Referring to FIG. 13, another patient transportation device, indicated generally at 400, is shown in accordance with another embodiment of the present invention that is similar in many respects to the patient transport device 10 described above and shown in FIGS. 1-8. Additionally, the patient transportation device 400 can have a plurality of connectors 440 that include an elastic hose 442 positioned in a preformed slot 444 in the backboard 411. The elastic hose 442 can have a plug 446, such as a dowel, placed into an end so as to enlarge the end 448 of the hose. The other end of the hose can be coupled to the removable handles 20. The preformed slot 444 can have an aperture 450 that can correspond in size and shape to the enlarged end of the hose with the remaining slot 452 being sized and shaped to contain the hose. In this way, the hose can be held in the preformed slot by the enlarged end.

Figure 14:
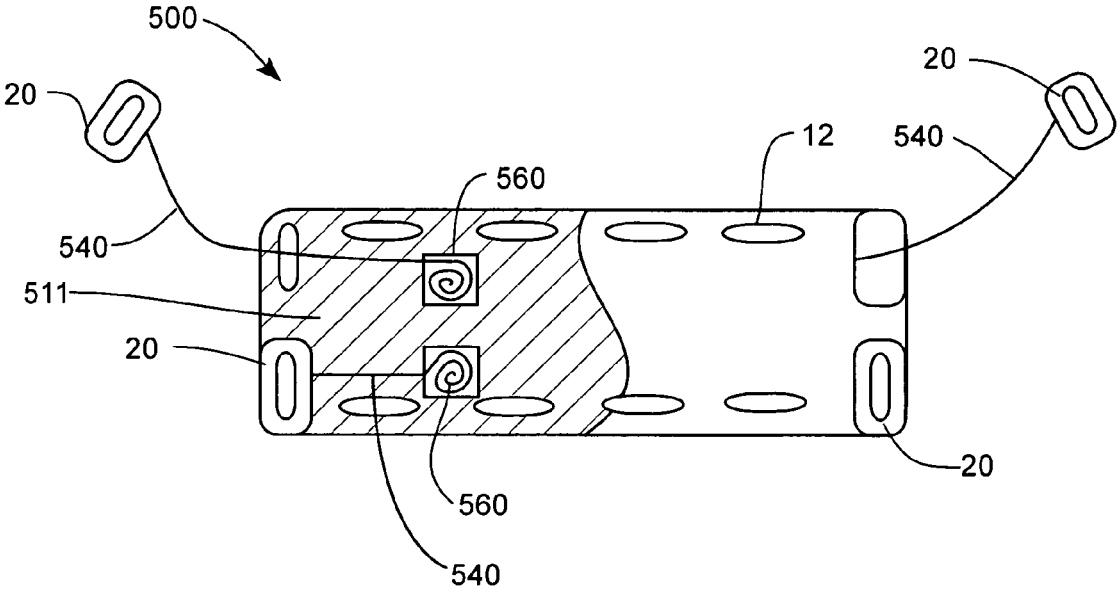
FIG. 14 is a top view of a patient transportation device in accordance with another embodiment of the present invention.

Referring to FIG. 14, another patient transportation device, indicated generally at 500, is shown in accordance with another embodiment of the present invention that is similar in many respects to the patient transport device 10 described above and shown in FIGS. 1-8. Additionally, the patient transportation device 500 can have a backboard 511 with a biasing device that can include a coil spring 560. The coil spring 560 can be coupled to the connectors 540 and can pull the connectors to retract the handles.

The present invention also provides for a method for transporting patients including positioning the patient on a rigid backboard. Removable handles can be displaced upward from the backboard to extend connectors coupled between the handles and the backboard. The backboard, with the patient disposed thereon, can be lifted by the extended handles.

The method can also include lowering the backboard to place the suspended backboard and patient on a support surface. The handles can be released to allow the handles to retract with respect to the backboard.

The method can also include securing the patient to the backboard prior to lifting the backboard.

Figure 15:
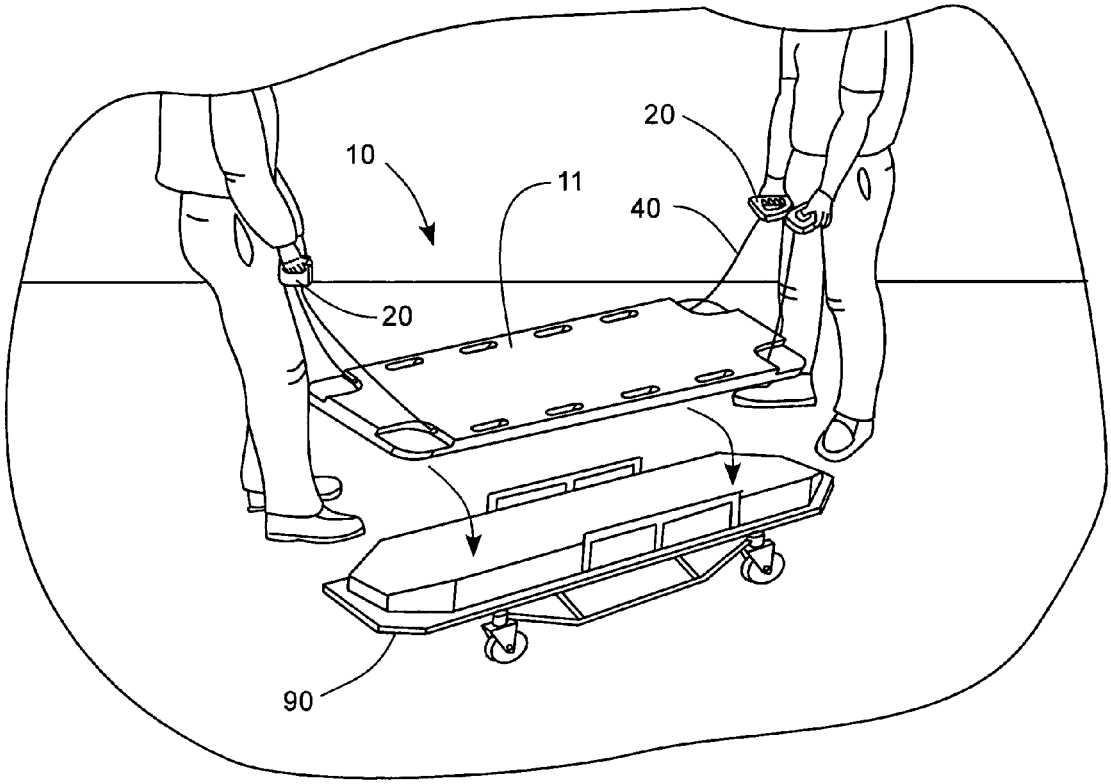
FIG. 15 illustrates a method for using a patient transportation device in accordance with an embodiment of the present invention.

As illustrated in FIG. 15, the method can also include lifting the handles 20 upward to suspend the backboard 11 of the patient lifting device 10 from the handles by the connectors 40 to a height approximately the height of a lowered gurney 90. In one aspect, the backboard 11 can be lifted to a height of approximately 18 inches. The backboard 11 and a gurney 90 can be positioned so that the gurney 90 is under the suspended backboard 11. The suspended backboard 11 and patient can be lowered to the gurney 90.

The present invention also provides for a method of manufacturing a patient transportation device including creating at least one channel in a bottom of a backboard configured to secure a patient thereon. The channel can extend longitudinally over a length of the backboard. At least one recess can be formed on a top side of the backboard on a peripheral edge of the backboard. The at least one recess can correspond in location to the at least one channel. At least one handle can be removably disposed in the at least one recess. A connector can be placed in the at least one channel and can extend through the channel longitudinally along a length of the backboard. The connector can be coupled to the at least one handle and secured to the backboard so that the handle can be removed from the recess. The handle can extend from the backboard and the connector can suspend the backboard from the handle. The connector and the handle can be retractable with respect to the backboard.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A patient transportation device, comprising:

a) a rigid backboard, with means for securing a patient on the backboard;

b) at least one retractable handle, extendibly and retractably coupled to the backboard;

c) at least one connector, coupled between the backboard and the at least one handle, and configured to suspend the backboard from the handle when the handle is extended from the backboard; and d) means for retracting the at least one handle to a retracted position with respect to the backboard, the means for retracting being selected from the group consisting of an elastic cord, a flexible cord, a spring, a linear spring, a tension spring, a coil spring, a pneumatic cylinder, a hydraulic cylinder, and combinations thereof.

2. A device in accordance with claim 1, wherein the at least one handle is extendible between a retracted position fixed with respect to the backboard and an elevated position elevated above the backboard.

3. A device in accordance with claim 2, further comprising:

a stopper coupled to the at least one connector and positioned on the connector so as to limit the elevation of the at least one handle when the at least one handle is extended to the elevated position.

4. A device in accordance with claim 1, further comprising:

at least one cavity associated with the backboard; and wherein the at least one connector and at least one handle are retractable into the at least one cavity in a retracted position.

5. A device in accordance with claim 1, further comprising:

a plurality of handles, extendibly coupled to the backboard by a plurality of connectors.

6. A device in accordance with claim 1, wherein at least one connector further includes a flexible cord or strap; and further comprising an elastic cord coupled between the flexible cord and the backboard.

7. A device in accordance with claim 1, wherein the at least one connector further includes at least one rigid rod pivotal with respect to the backboard.

8. A device in accordance with claim 1, wherein the backboard further includes at least one handle receptacle sized and shaped to receive the at least one handle.

9. A device in accordance with claim 8, wherein the handle receptacle includes an undercut so that a portion of the backboard overlaps a portion of the handle.

10. A device in accordance with claim 8, wherein the at least one handle receptacle further includes a recess in a top surface of the backboard.

11. A device in accordance with claim 1, wherein the at least one handle further includes a handle extendible from an end of the backboard and another handle extendible from an opposite end of the backboard.

12. A method for transporting patients, comprising:

a) positioning the patient on or over a rigid backboard;

b) displacing at least one retractable handle from a stowed position fixed with respect to the backboard to extend at least one connector coupled between the handle and the backboard;

c) lifting the backboard by the at least one handle with the patient disposed thereon; and d) releasing the at least one handle to allow a means for retracting to retract the handle with respect to the backboard, the means for retracting being selected from the group consisting of: an elastic cord, a flexible cord, a spring, a linear spring, a tension spring, a coil spring, a pneumatic cylinder, a hydraulic cylinder, and combinations thereof.

13. A method in accordance with claim 12, further comprising:

a) lowering the backboard and patient.

14. A method in accordance with claim 12, further comprising:

a) positioning the backboard and a gurney so that the gurney is under the suspended backboard; and b) lowering the suspended backboard to the gurney.

15. A method in accordance with claim 12, further comprising:

pulling the at least one retractable handle against means for retracting the at least one handle.

16. A patient transportation device, comprising:

a) a rigid backboard, with means for securing a patient on the backboard;

b) at least one retractable handle, extendibly and retractably coupled to the backboard;

c) at least one connector, coupled between the backboard and the at least one handle, and configured to suspend the backboard from the handle when the handle is extended from the backboard; and d) at least one cavity associated with the backboard such that the at least one connector and at least one handle are retractable into the at least one cavity in a retracted position.

17. A patient transportation device, comprising:

a) a rigid backboard, with means for securing a patient on the backboard;

b) at least one retractable handle, extendibly and retractably coupled to the backboard; and c) at least one connector, coupled between the backboard and the at least one handle, and configured to suspend the backboard from the handle when the handle is extended from the backboard, the at least one connector further comprising:

i) a flexible cord or strap coupled to the handle; and ii) an elastic cord coupled between the flexible cord and the backboard.

18. A patient transportation device, comprising:

a) a rigid backboard, with means for securing a patient on the backboard;

b) at least one retractable handle, extendibly and retractably coupled to the backboard;

c) at least one connector, coupled between the backboard and the at least one handle, and configured to suspend the backboard from the handle when the handle is extended from the backboard; and d) at least one handle receptacle sized and shaped to receive the at least one handle.

19. A device in accordance with claim 18, wherein the handle receptacle includes an undercut so that a portion of the backboard overlaps a portion of the handle.

20. A device in accordance with claim 18, wherein the at least one handle receptacle further includes a recess in a top surface of the backboard.

* * * * *